US009462394B2

(12) United States Patent
Sher et al.

(10) Patent No.: US 9,462,394 B2
(45) Date of Patent: Oct. 4, 2016

(54) SPLICING TYPE ELECTRET LOUDSPEAKER

(71) Applicant: AMAZING MICROELECTRONIC CORP., New Taipei (TW)

(72) Inventors: Mou-Ong Sher, New Taipei (TW); Ryan Hsin-Chin Jiang, Taipei (TW); Ming-Che Hsieh, New Taipei (TW)

(73) Assignee: AMAZING MICROELECTRONIC CORP., New Taipei (TW)

( * ) Notice: Subject to any disclaimer, the term of this patent is extended or adjusted under 35 U.S.C. 154(b) by 0 days.

(21) Appl. No.: 14/587,827

(22) Filed: Dec. 31, 2014

(65) Prior Publication Data

US 2016/0192083 A1 Jun. 30, 2016

(30) Foreign Application Priority Data

Sep. 26, 2014 (TW) ..... 103133528 A

(51) Int. Cl.
*H04R 25/00* (2006.01)
*H04R 19/01* (2006.01)

(52) U.S. Cl.
CPC ..... *H04R 19/013* (2013.01)

(58) Field of Classification Search
CPC ..... H04R 19/00; H04R 19/013; H04R 19/02
See application file for complete search history.

(56) References Cited

U.S. PATENT DOCUMENTS

2013/0128130 A1* 5/2013 Yamauchi ..... H04N 5/642 348/836

* cited by examiner

*Primary Examiner* — Tuan D Nguyen
(74) *Attorney, Agent, or Firm* — WPAT, PC; Justin King

(57) ABSTRACT

The present invention discloses a splicing type electret loudspeaker. The splicing type electret loudspeaker may comprise a plurality of electret loudspeaker units. Each electret loudspeaker unit may comprise a plurality of connection ports, and these connection ports may be disposed around the edge of each electret loudspeaker unit. In particular, the connection ports of each electret loudspeaker unit can respectively connect to one of the connection ports of another electret loudspeaker unit; in this way, these electret loudspeaker units can connect to each other in parallel, such that the power input signal and the audio input signal can be transmitted to all electret loudspeaker units to drive them.

12 Claims, 8 Drawing Sheets

SPLICING TYPE ELECTRET LOUDSPEAKER

CROSS-REFERENCE TO RELATED APPLICATION

This application claims the benefit of Taiwan Patent Application No. 103133528, filed on Sep. 26, 2014, in the Taiwan Intellectual Property Office, the disclosure of which is incorporated herein in its entirety by reference.

BACKGROUND OF THE INVENTION

1. Field of the Invention

The present invention generally relates to an electret loudspeaker, in particular to a splicing type electret loudspeaker capable of connecting a plurality of electret loudspeaker units and driving all electret loudspeaker units by only one audio and power input unit.

2. Description of the Related Art

In recent years, people have gradually paid their attention to the application and development of flexible electret loudspeakers; therefore, the products related to the technology appear in the market one after another. The electret loudspeaker is known as electrostatic speaker or paper speaker; Taiwan Industrial Technology Research Institute is the first to develop the product. The product includes an electret film made by electret material; the electret film can be driven by low voltage to produce sound.

The obvious differences between the electret loudspeaker and the conventional loudspeakers are that the electret loudspeaker has many advantages that the conventional loudspeakers do not have, such as small size, high efficiency, low power consumption, ultra-thin and the like; besides, the applications of the electret loudspeaker is much more comprehensive than the conventional loudspeakers. Currently, the electret loudspeaker can be already put into mass production.

Although the electret loudspeaker has been applied in many different industries, such as consumer electronics and automobile electronics, etc.; however, these applications fail to completely exploit the advantages of the electret loudspeaker; besides, there is no a product capable of combining the electret loudspeaker with home life, interior design and housing decoration, etc.

Therefore, it has become an important issue to provide a novel electret loudspeaker capable of completely exploit the advantages of electret loudspeaker and combining the electret loudspeaker with home life, interior design, housing decoration and the like.

SUMMARY OF THE INVENTION

Therefore, it is one of the primary objects of the present invention to provide novel electret loudspeaker capable of completely exploit the advantages of electret loudspeaker and combining the electret loudspeaker with home life, interior design, housing decoration and the like.

To achieve the foregoing objective, the present invention provides a splicing type electret loudspeaker. The splicing type electret loudspeaker may comprise a plurality of electret loudspeaker units. Each electret loudspeaker unit may comprise a plurality of connection ports, and these connection ports may be disposed around the edge of each electret loudspeaker unit. In particular, the connection ports of each electret loudspeaker unit can respectively connect to one of the connection ports of another electret loudspeaker unit; in this way, these electret loudspeaker units can connect to each other in parallel, such that the power input signal and the audio input signal can be transmitted to all electret loudspeaker units to drive them.

In a preferred embodiment of the present invention, the splicing type electret loudspeaker may further comprise an audio and power input unit, wherein the audio and power input unit may be connected to the connection port of one of the electret loudspeaker units to provide the power input signal and the audio input signal.

In a preferred embodiment of the present invention, each electret loudspeaker may further comprise a casing, a circuit board, a driving module and an electret film; the circuit board, the driving module, the electret film and the connection ports may be contained within the casing; the driving module and the connection ports may be disposed on the circuit board, and the driving module may be connected to the electret film and the connection ports via the circuit board, and the connection ports may be connected to each other via the circuit board.

In a preferred embodiment of the present invention, the connection ports of each electret loudspeaker unit may be respectively connected to one of the connection ports of another electret loudspeaker unit via an adaption board.

In a preferred embodiment of the present invention, the casing of each electret loudspeaker unit may further comprise a plurality of auxiliary slots, and the auxiliary slots may be disposed around the connection ports of each electret loudspeaker unit.

In a preferred embodiment of the present invention, the audio and power input unit may be connected to an audio output device via a wireless transmission device or a wired transmission device in order to receive the audio input signal and the power input signal.

In a preferred embodiment of the present invention, the wireless transmission device may comprise Bluetooth, devices based on IrDA communication protocols or devices based on IEEE802.11b.

In a preferred embodiment of the present invention, the electret loudspeaker units may be rectangular, polygonal, circular, elliptical, triangle or irregular in shape.

In a preferred embodiment of the present invention, the upper surface of each electret loudspeaker unit may be wavy in shape.

In a preferred embodiment of the present invention, the upper surface of each electret loudspeaker unit may further comprise a plurality of grooves.

In a preferred embodiment of the present invention, the casing of each electret loudspeaker unit may further comprise a plurality of sound holes, and the sound holes may be disposed at the grooves of the upper surface of the electret loudspeaker unit.

In a preferred embodiment of the present invention, the casing of each electret loudspeaker unit may further comprise a plurality of auxiliary sound holes, and the auxiliary sound holes may be disposed at the lower surface of the casing.

The splicing type electret loudspeaker according to the present invention has the following advantages:

(1) One preferred embodiment of the present invention provides a novel splicing type electret loudspeaker capable of splicing a plurality of electret loudspeaker units with specially-designed appearance with each other, which completely breaks through the limitation that the conventional loudspeakers cannot be connected to each other. The splicing type electret loudspeaker can not only be installed on walls or various positions of a house as decoration to beautify the living space and make it more fashionable, but also can play music or broadcasting programs, etc.

(2) One preferred embodiment pf the present invention provides a novel circuit structure to connect a plurality of electret loudspeaker units in parallel; therefore, the electret loudspeaker can be driven by only one audio and power input unit.

(3) In one preferred embodiment of the present invention, each electret loudspeaker has a plurality of connection ports arranged around its periphery, so each side of the electret loudspeaker unit can be connected to another electret loudspeaker unit; therefore, the appearance of the splicing type electret loudspeaker can vary with the geometrical shape or the arrangement of the electret loudspeaker units. Besides, the texture and appearance of the electret loudspeaker unit can be changed according to actual requirements. The user can determine the number of the electret loudspeaker units according to the size of the space or cost.

(4) The present invention can take full advantages of the characteristics of the electret loudspeaker to make each of electret loudspeaker unit look like a "music brick", which can replace the conventional loudspeakers in most applications.

(5) The splicing type electret loudspeaker according to the prevent invention can be comprehensively applied in many different applications, such as interior design, housing decoration, commercial space decoration. Accordingly, the splicing type electret loudspeaker according to the prevent invention can provides more choices for interior designers and consumers, and is of great commercial value.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

Figure 1:
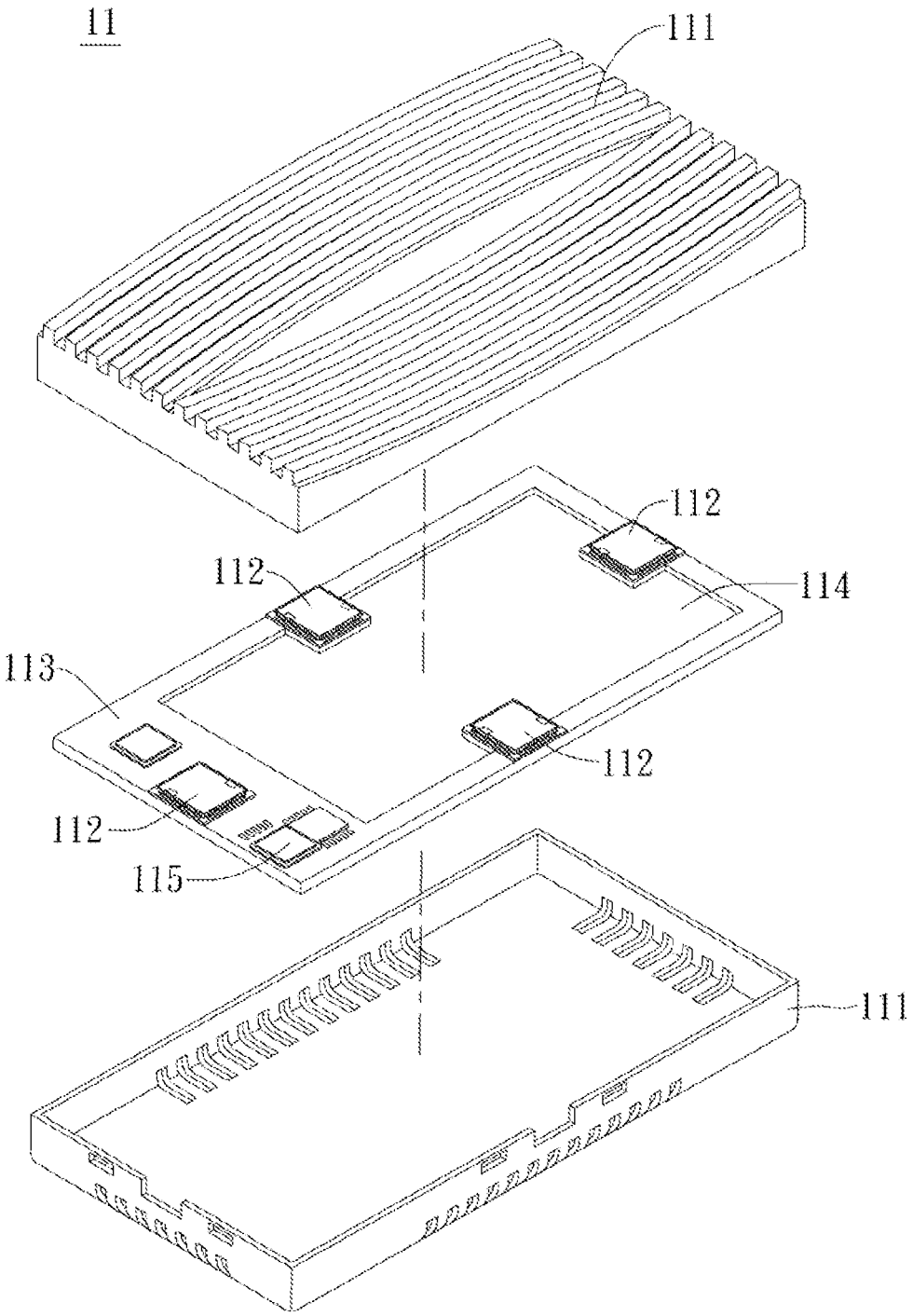
FIG. 1 is the first schematic view of the first embodiment of a splicing type electret loudspeaker in accordance with the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Please refer to FIG. 1, which is the first schematic view of the first embodiment of a splicing type electret loudspeaker in accordance with the present invention, which shows the structure of one of the electret loudspeaker units 11 of the splicing type electret loudspeaker 1 of the embodiment.

As shown in FIG. 1, the electret loudspeaker unit 11 comprises a casing 111, a plurality of connection ports 112, a circuit board 113, an electret film 114 and a driving module 115. The circuit board 113, the driving module 115, the electret film 114 and the connection ports 112 are contained within the casing 111. The driving module 115 and the connection ports are disposed on the circuit board 113. The driving module 115 includes many components, such as converter, etc.; the driving module 115 is connected to the electret film 114 and the connection ports 112 via the traces of the circuit board 113; the connection ports 112 are connected to the circuit board 113 with each other via the traces of the circuit board 113.

In the embodiment, the electret loudspeaker unit 11 is rectangular in shape and each side of the electret loudspeaker unit 11 has one connection port 112 and one of the connection ports 112 may be connected to an audio and power input unit; the audio and power input unit can receive a power input signal and an audio input signal. Other connection ports 112 of the electret loudspeaker units 1 can be selectively connected to the connection ports 112 of another electret loudspeaker unit 11, such that the electret loudspeaker units can be connected to each other in parallel, and the power input signal and the audio input signal can be transmitted to the driving modules 115 of all electret loudspeaker units 11 to drive their electret films 114 to vibrate and then produce sound.

The aforementioned structure and circuit design are just for example instead of limitation; the present invention is not limited thereto.

It is particularly noteworthy that the conventional loudspeakers adopt resistive load, so the conventional loudspeakers connected in parallel will result in low impedance; therefore, it is impossible to connect multiple conventional loudspeakers in parallel. On the contrary, the electret loudspeaker adopts capacitive load, so multiple electret loudspeakers connected in parallel will result in high impedance; hence, it is feasible to connect multiple electret loudspeakers in parallel. The prevent invention takes full advantage of the aforementioned characteristic of the electret loudspeaker to design a novel circuit structure to connect a plurality of electret loudspeakers to each other; accordingly, all electret loudspeakers can be driven by only one audio and power input source, which makes the application of the electret loudspeaker more comprehensive.

Figure 2:
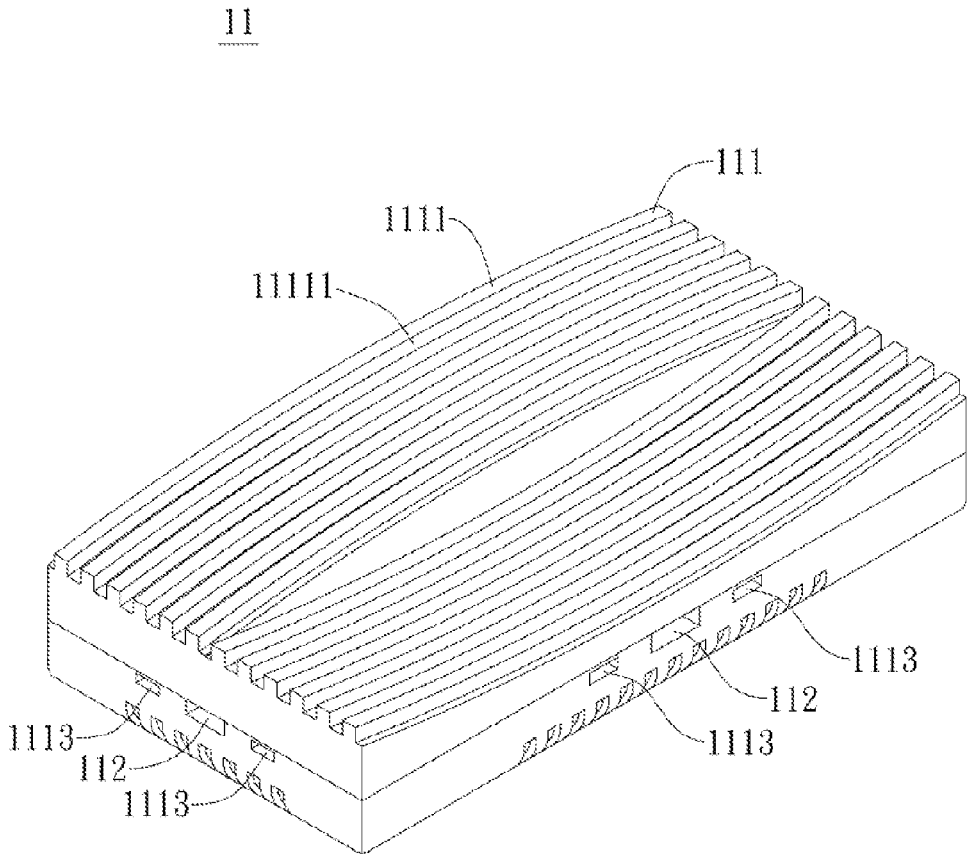
FIG. 2 is the second schematic view of the first embodiment of a splicing type electret loudspeaker in accordance with the present invention.
Figure 3:
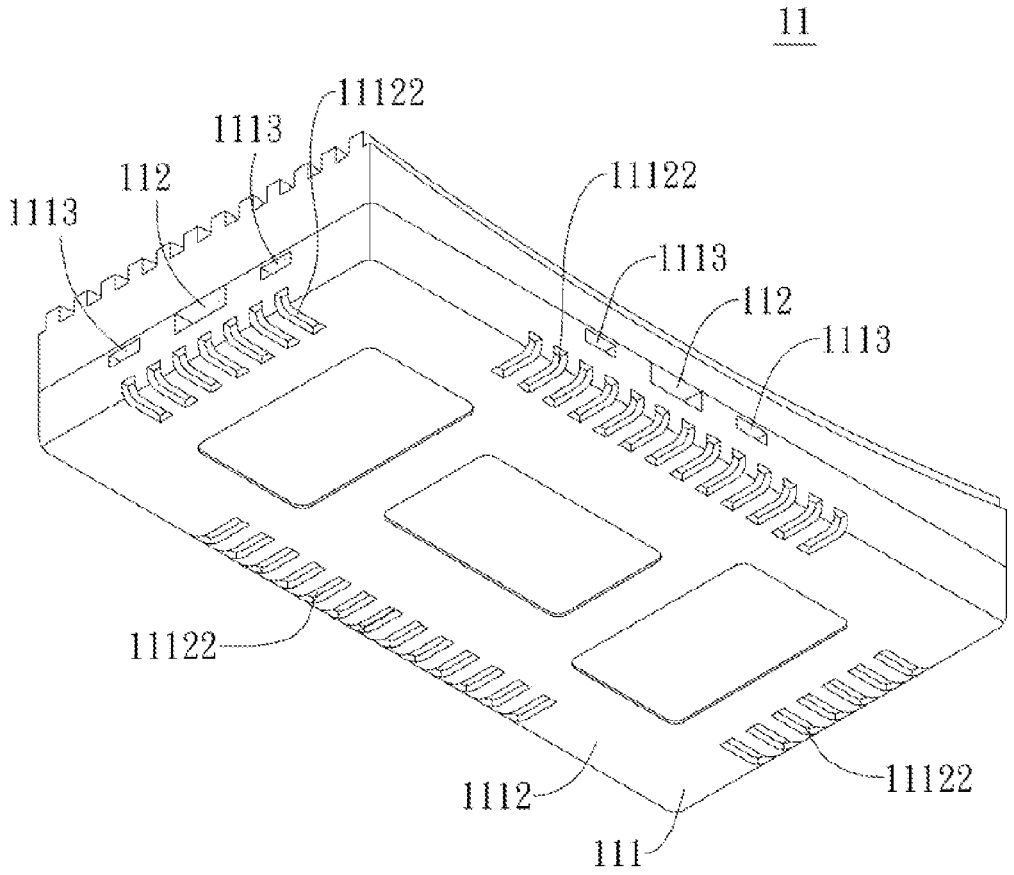
FIG. 3 is the third schematic view of the first embodiment of a splicing type electret loudspeaker in accordance with the present invention.
Figure 4:
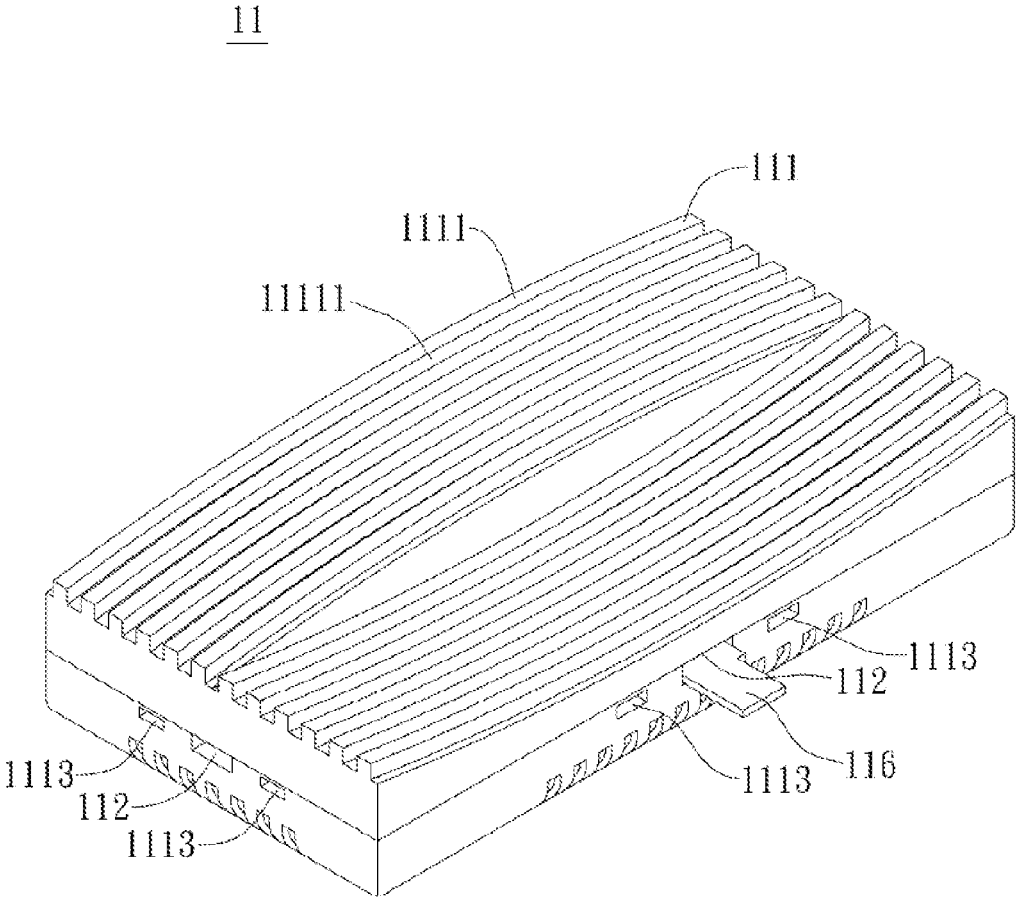
FIG. 4 is the fourth schematic view of the first embodiment of a splicing type electret loudspeaker in accordance with the present invention.

Please refer to FIG. 2, FIG. 3 and FIG. 4, which are the second, third and fourth schematic view of the first embodiment of a splicing type electret loudspeaker in accordance with the present invention. FIG. 2, FIG. 3 and FIG. 4 show the appearance and structure of one of the electret loudspeaker units 11 of the electret loudspeaker.

As shown in FIG. 2, in the embodiment, the electret loudspeaker unit is a light and thin "music brick" rectangular in shape, which looks like a ceramic tile. The upper surface 1111 of the electret loudspeaker unit 11 is wavy in shape and disposed with a plurality of grooves 11111. A plurality of sound holes can be hidden in these grooves 11111. Each side of the electret loudspeaker unit 11 has a connection port 112 and the both sides of each connection port 112 can be disposed with an auxiliary slot respectively in order to firmly connect the electret loudspeaker units to each other.

The aforementioned structure and appearance are just for example instead of limitation; the electret loudspeaker unit 11 may be rectangular, polygonal, circular, elliptical, triangle or irregular, etc. and the structure and appearance of the electret loudspeaker unit 11 can be changed according to actual requirements; the present invention is not limited thereto.

As shown in FIG. 3, the lower surface of the electret loudspeaker unit 11 comprises a plurality of auxiliary sound holes 11122 and the electret loudspeaker unit 11 can be fixed on the wall or other positions in a variety of ways. For instance, the electret loudspeaker unit 11 can be fixed on the wall by double side tape.

As shown in FIG. 4, each connection port 112 of the electret loudspeaker unit 11 can be connected to the connection port 112 of another electret loudspeaker unit 11 via an adaption board 116 so as to transmit the power input signal and audio input signal; the adaption board 116 may have a fool-proofing device.

The aforementioned structure is just for example instead of limitation; the structure of the electret loudspeaker unit 11 can be changed according to actual requirements; the present invention is not limited thereto.

Figure 5:
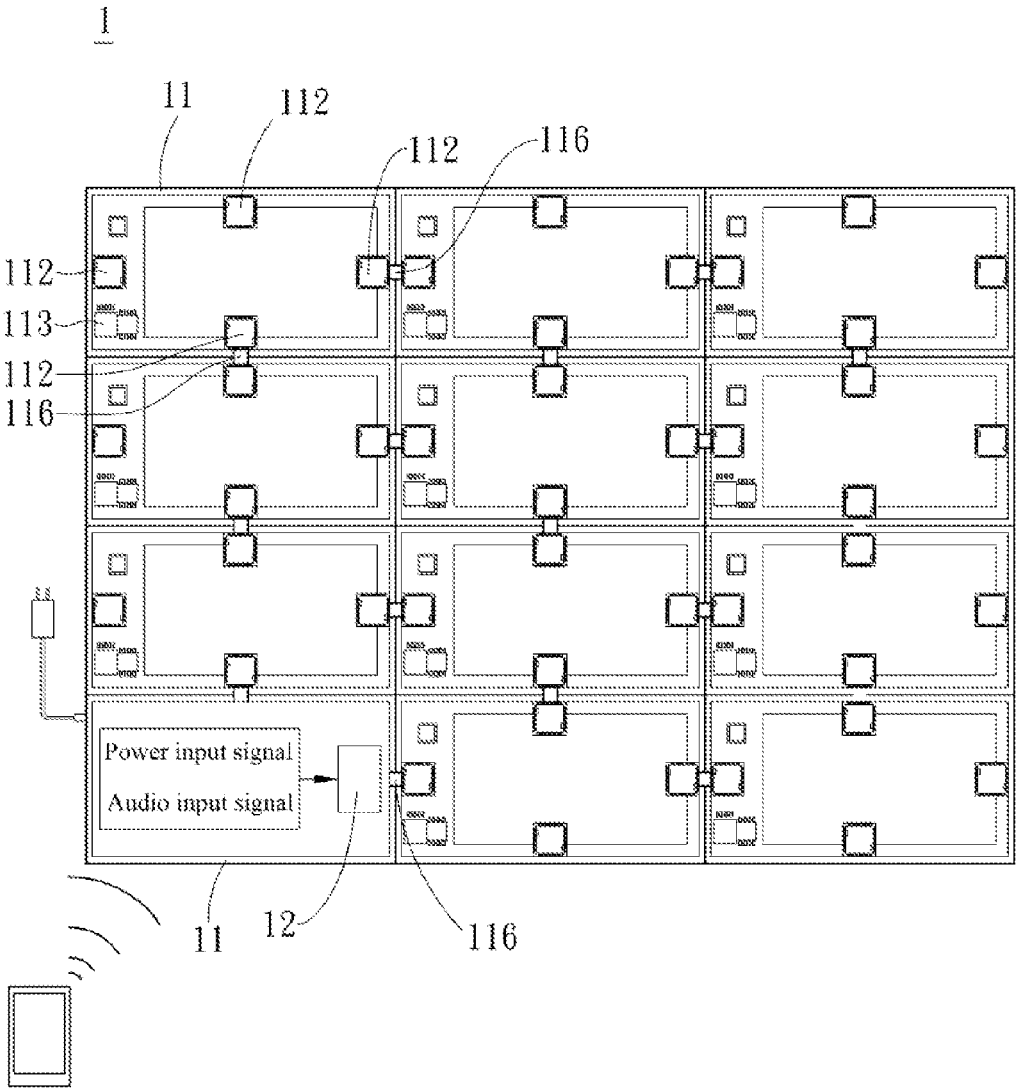
FIG. 5 is the fifth schematic view of the first embodiment of a splicing type electret loudspeaker in accordance with the present invention.

Please refer to FIG. 5, which is the fifth schematic view of the first embodiment of a splicing type electret loudspeaker in accordance with the present invention, which shows the splicing type electret loudspeaker 1 composed of a plurality of electret loudspeaker units 11 according to the present invention.

As shown in FIG. 5, the audio and power input unit 12 can be disposed at the casing 111 with the appearance the same with each electret loudspeaker unit 11 and receive the power input signal and the audio input signal inputted by external power output device and audio output device. Many different devices can serve as the power output device, such as socket on a wall, battery, or wireless power supply, etc. Similarly, many different devices can serve as the audio output device, such as smart phone, notebook computer, etc. Besides, the audio input signal can be transmitted to the audio and power input unit 12 by various wireless and wired transmission devices; for example, the audio input signal can be transmitted to the audio and power input unit 12 via the Bluetooth of a smart phone. In other preferred embodiments, the wireless transmission device can be the devices based on IrDA (Infrared Data Association) communication protocols or devices based on IEEE802.11b.

Each electret loudspeaker unit 11 comprises four connection ports 112, a circuit board 113, an electret film 114 and a driving module 115. The four connection ports 112 are respectively disposed at the four sides of the rectangular electret loudspeaker unit 11; the driving module 115 is connected to the electret film 114 and the connection ports 112 via the traces of the circuit board 113.

The audio and power input unit 12 can be connected to one of the connection port 112 of any one electret loudspeaker unit 11; and the other connection ports 112 of the electret loudspeaker unit 11 can be connected to another electret loudspeaker unit 11 respectively via the adaption board 116. In this way, a plurality of electret loudspeaker units 11 can be spliced to form the splicing type electret loudspeaker 1; besides, the electret loudspeaker units 11 are connected in parallel, so the power input signal and audio input signal inputted by the audio and power input unit 12 can drive all of the electret loudspeaker units 11.

Figure 6:
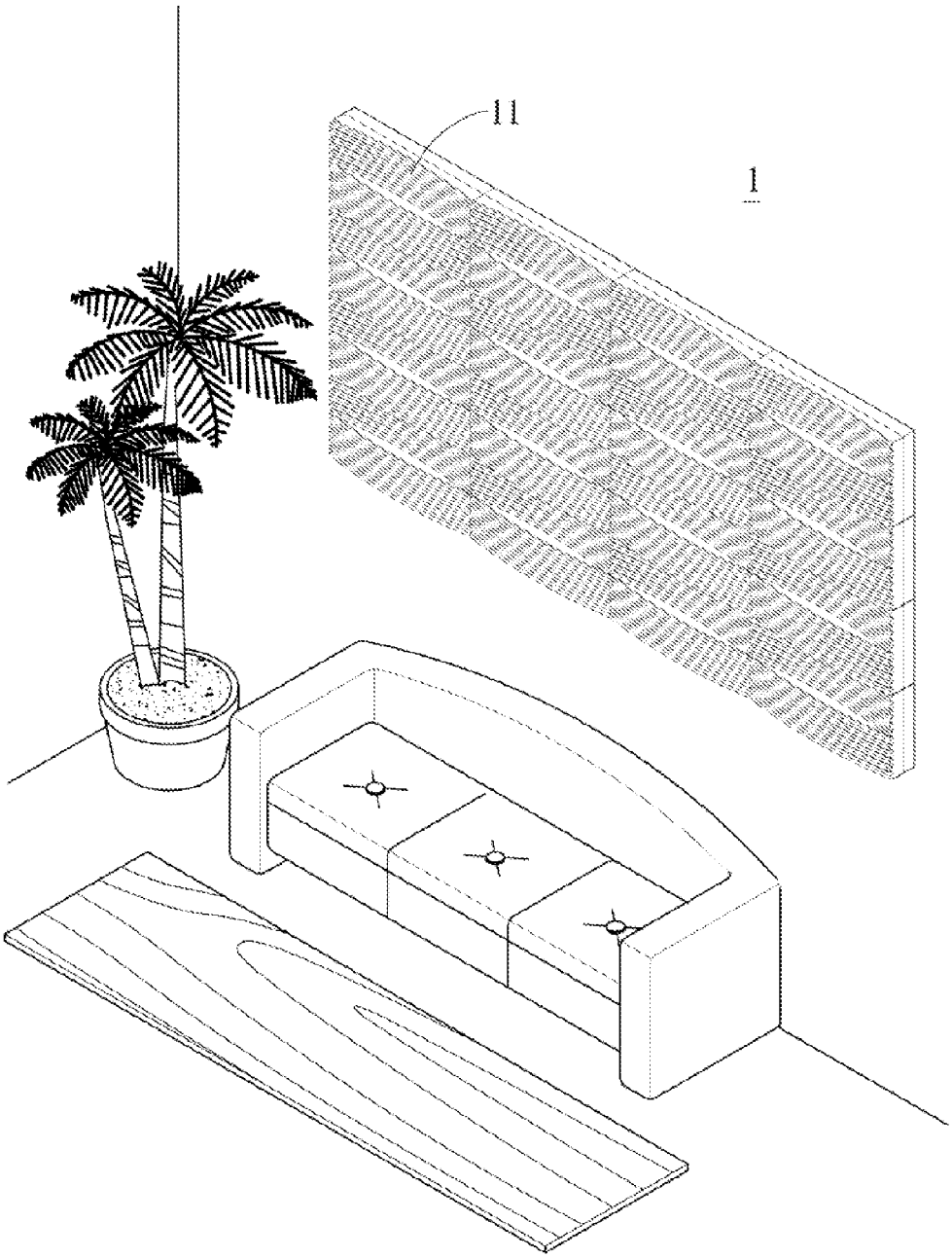
FIG. 6 is the six schematic view of the first embodiment of a splicing type electret loudspeaker in accordance with the present invention.

Please refer to FIG. 6, which is the sixth schematic view of the first embodiment of a splicing type electret loudspeaker in accordance with the present invention, which shows the use case of the splicing type electret loudspeaker 1 composed of a plurality of electret loudspeaker units 11 according to the present invention.

In the embodiment, the electret loudspeaker unit 11 is a light, thin, rectangular "music brick", which looks just like a ceramic tile. The user can determine the number and arrangement of the electret loudspeaker units 11 of the splicing type electret loudspeaker 1 according to actual requirements, The specially-designed multi-functional "music brick" can not only play music, but also can serve as decoration to beautify the living space and make the living space look more fashionable.

It is particularly noteworthy that the use of the conventional loudspeakers is lack of flexibility due to various limitations. On the contrary, the embodiment of the present invention successfully splices the light and thin electret loudspeaker units with specially-designed appearance to each other, which not only completely breaks through the limitation that the conventional loudspeakers cannot be connected to each other, but also takes full advantage of the characteristics of the electret loudspeaker.

The splicing type electret loudspeaker can be installed on various positions, such as the wall of a living room, which can not only completely replace the conventional loudspeakers in most applications, but also can serve as the decoration of the living space to beautify the living space and make it look more fashionable. Accordingly, the splicing type electret loudspeaker can be comprehensively applied to interior design, housing decoration, hotel decoration or other commercial space decorations, which provides more choices for interior designers and consumers, and is of great commercial value. Thus, the splicing type electret loudspeaker according to the present invention definitely has an inventive step.

Figure 7:
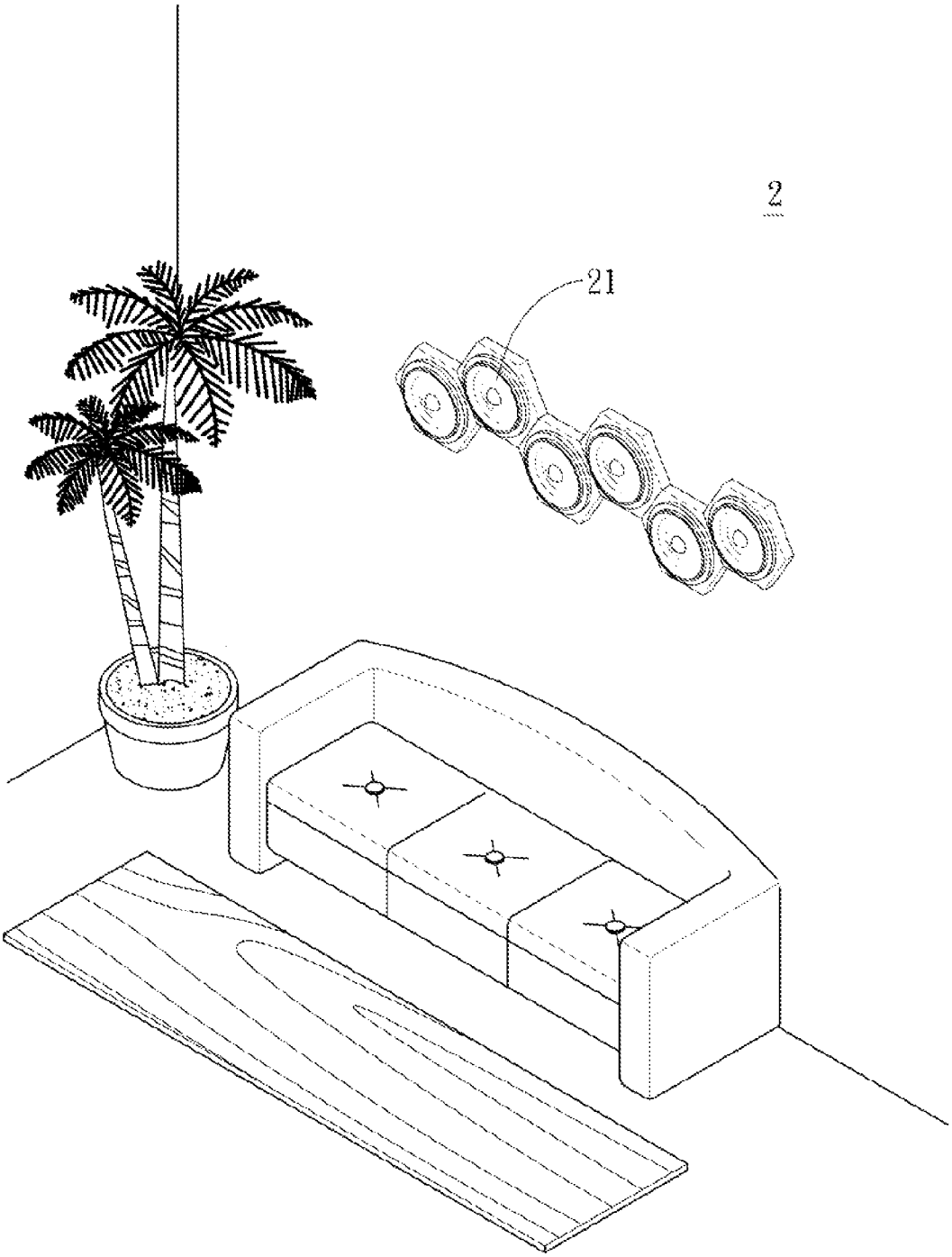
FIG. 7 is the schematic view of the second embodiment of a splicing type electret loudspeaker in accordance with the present invention.

Please refer to FIG. 7, which is the schematic view of the second embodiment of a splicing type electret loudspeaker in accordance with the present invention, which shows the use case of the splicing type electret loudspeaker 2 composed of a plurality of electret loudspeaker units 21 according to the present invention.

As shown in FIG. 7, the splicing type electret loudspeaker 2 is composed of a plurality of electret loudspeaker units 21 and the electret loudspeaker unit 21 is a hexagonal "music brick" with 3D texture. The six sides of each electret loudspeaker unit 21 can be selectively connected to another electret loudspeaker unit 21 to form a special arrangement; therefore, the user can change the arrangement according to actual requirements to achieve different visual effects.

It is particularly noteworthy that the conventional electret loudspeakers cannot completely take advantage of their characteristics because of their design limitations; therefore, they cannot be effectively applied to home life, interior design and housing decoration, etc.

On the contrary, the electret loudspeaker unit of the preferred embodiments of the present invention has a plurality of connection ports disposed over its periphery, so each side of each electret loudspeaker unit can be selectively connected to another electret loudspeaker unit; besides, the electret loudspeaker unit can has various geometrical shapes; therefore, the electret loudspeaker units can be spliced to form an electret loudspeaker with specific pattern; further, the texture and appearance of the electret loudspeaker unit can be changed to create different 3D effects.

Also, the user can determine the number, appearance and arrangement of the electret loudspeaker units according to the cost, size of the space or desired atmosphere. Thus, the electret loudspeaker according to the present invention is very flexible in use and can achieve great effect.

Figure 8:
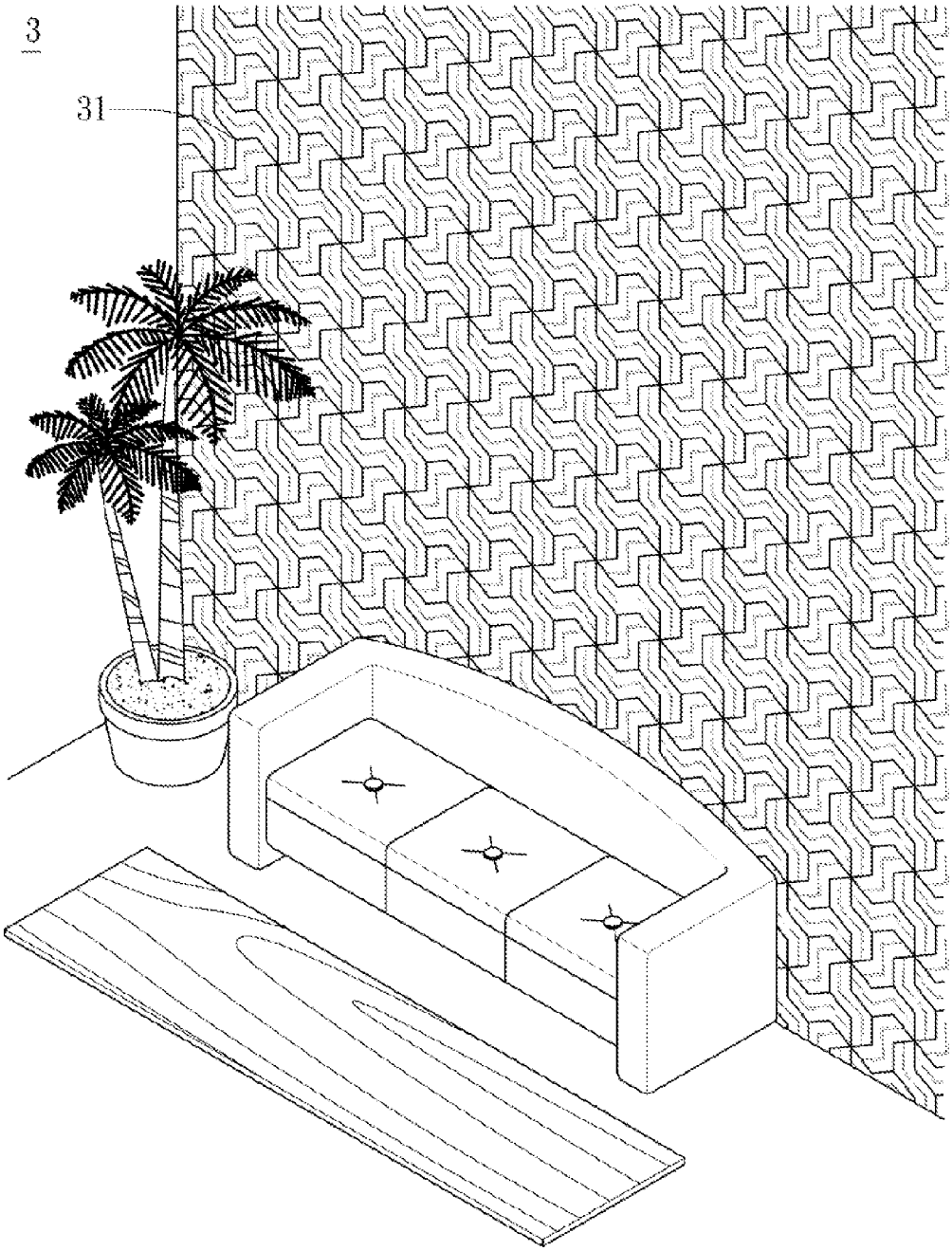
FIG. 8 is the schematic view of the third embodiment of a splicing type electret loudspeaker in accordance with the present invention.

Please refer to FIG. 8, which is the schematic view of the second embodiment of a splicing type electret loudspeaker in accordance with the present invention, which shows the use case of the splicing type electret loudspeaker 3 composed of a plurality of electret loudspeaker units 31 according to the present invention.

The splicing type electret loudspeaker 3 is composed of a plurality of electret loudspeaker units 31 and the electret loudspeaker unit 31 is a "music brick" with irregular shape and 3D texture. As shown in FIG. 8, the splicing type electret loudspeaker 3 can completely cover the wall to create special visual effect.

In summation of the description above, one preferred embodiment of the present invention provides a novel splicing type electret loudspeaker capable of splicing a plurality of electret loudspeaker units with specially-designed appearance with each other, which completely breaks through the limitation that the conventional loudspeakers cannot be connected to each other. The splicing type electret loudspeaker can not only be installed on walls or various positions of a house as decoration to beautify the living space and make it more fashionable, but also can play music or broadcasting programs, etc.

Also, one preferred embodiment pf the present invention provides a novel circuit structure to connect a plurality of electret loudspeaker units in parallel; therefore, the electret loudspeaker can be driven by only one audio and power input unit.

Besides, in the preferred embodiment pf the present invention, each electret loudspeaker has a plurality of connection ports arranged around its periphery, so each side of the electret loudspeaker unit can be connected to another electret loudspeaker unit; therefore, the appearance of the splicing type electret loudspeaker can vary with the geometrical shape or the arrangement of the electret loudspeaker units. Besides, the texture and appearance of the electret loudspeaker unit can be changed according to actual requirements. The user can determine the number of the electret loudspeaker units according to the size of the space or cost. Thus, the splicing type electret loudspeaker is very flexible in use.

Further, the present invention takes full advantage of the characteristics of the electret loudspeaker to make each of electret loudspeaker unit look like a "music brick", which can replace the conventional loudspeakers in most applications.

Moreover, as the splicing type electret loudspeaker according to the prevent invention can achieve the above effects, it can be comprehensively applied in many different applications, such as interior design, housing decoration, commercial space decoration. Accordingly, the splicing type electret loudspeaker according to the prevent invention can provides more choices for interior designers and consumers, and is of great commercial value.

The disclosure being thus described, it will be obvious that the same may be varied in many ways. Such variations are not to be regarded as a departure from the spirit and scope of the disclosure, and all such modifications as would be obvious to one skilled in the art are intended to be included within the scope of the following claims.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A splicing type electret loudspeaker, comprising:

a plurality of electret loudspeaker units, each electret loudspeaker unit comprising a plurality of connection ports, the connection ports being disposed around an edge of each electret loudspeaker unit and connected to each other;

wherein the connection ports of each electret loudspeaker unit are respectively connected to one of the connection ports of another electret loudspeaker unit, whereby the electret loudspeaker units are able to be connected to form various patterns, and the electret loudspeaker units are connected to each other in parallel and a power input signal, and an audio input signal is able to transmit to all of the electret loudspeaker units and drive all of the electret loudspeaker units.

2. The loudspeaker of claim 1, further comprising an audio and power input unit, wherein the audio and power input unit is connected to the connection port of one of the electret loudspeaker units to provide the power input signal and the audio input signal.

3. The loudspeaker of claim 1, wherein each electret loudspeaker further comprises a casing, a circuit board, a driving module and an electret film; the circuit board, the driving module, the electret film and the connection ports are contained within the casing; the driving module and the connection ports are disposed on the circuit board, and the driving module is connected to the electret film and the connection ports via the circuit board, and the connection ports are connected to each other via the circuit board.

4. The loudspeaker of claim 3, wherein the connection ports of each electret loudspeaker unit are respectively connected to one of the connection ports of another electret loudspeaker unit via an adaption board.

5. The loudspeaker of claim 4, wherein the casing of each electret loudspeaker unit further comprises a plurality of auxiliary slots, and the auxiliary slots are disposed around the connection ports of each electret loudspeaker unit.

6. The loudspeaker of claim 2, wherein the audio and power input unit is connected to an audio output device via a wireless transmission device or a wired transmission device in order to receive the audio input signal and the power input signal.

7. The loudspeaker of claim 6, wherein the wireless transmission device comprises Blue tooth, devices based on Infrared Data Association communication protocols or devices based on IEEE802.11b.

8. The loudspeaker of claim 5, wherein the electret loudspeaker units are rectangular, polygonal, circular, elliptical, triangle or irregular in shape.

9. The loudspeaker of claim 8, wherein an upper surface of each electret loudspeaker unit is wavy in shape.

10. The loudspeaker of claim 9, wherein the upper surface of each electret loudspeaker unit further comprises a plurality of grooves.

11. The loudspeaker of claim 10, wherein the casing of each electret loudspeaker unit further comprises a plurality of sound holes, and the sound holes are disposed at the grooves of the upper surface of the electret loudspeaker unit.

12. The loudspeaker of claim 11, wherein the casing of each electret loudspeaker unit further comprises a plurality of auxiliary sound holes, and the auxiliary sound holes are disposed at a lower surface of the casing.

* * * * *